US009348348B2

(12) United States Patent
Kronmueller et al.

(10) Patent No.: US 9,348,348 B2
(45) Date of Patent: May 24, 2016

(54) ACTIVE CLAMPS FOR MULTI-STAGE AMPLIFIERS IN OVER/UNDER-VOLTAGE CONDITION

(71) Applicant: Dialog Semiconductor GmbH, Kirchheim/Teck-Nabern (DE)

(72) Inventors: Frank Kronmueller, Neudenau (DE); Mahir Uka, Ulm (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 142 days.

(21) Appl. No.: 14/191,624

(22) Filed: Feb. 27, 2014

(65) Prior Publication Data

US 2014/0375289 A1 Dec. 25, 2014

(30) Foreign Application Priority Data

Jun. 20, 2013 (EP) ..... 13173089

(51) Int. Cl.
*G05F 1/571* (2006.01)
*G05F 1/56* (2006.01)
*G05F 1/565* (2006.01)

(52) U.S. Cl.
CPC . *G05F 1/56* (2013.01); *G05F 1/565* (2013.01)

(58) Field of Classification Search
CPC ..... G05F 1/461; G05F 1/56; G05F 1/565; G05F 1/569
USPC ..... 323/273, 274, 275, 276
See application file for complete search history.

(56) References Cited

U.S. PATENT DOCUMENTS

| | | | | |
|---|---|---|---|---|
| 6,294,941 | B1 | 9/2001 | Yokosawa | |
| 2006/0043945 | A1 | 3/2006 | Sohn et al. | |
| 2008/0030914 | A1 | 2/2008 | Jahelka et al. | |
| 2009/0033420 | A1 | 2/2009 | Negoro | |
| 2009/0224740 | A1* | 9/2009 | Imura | G05F 1/575 323/282 |
| 2009/0261800 | A1 | 10/2009 | Pan | |
| 2009/0273323 | A1* | 11/2009 | Kimura | G05F 1/575 323/265 |
| 2010/0156362 | A1 | 6/2010 | Xie | |

OTHER PUBLICATIONS

European Search Report 13173089.7-1807 Mailed: Jan. 28, 2014, Dialog Semiconductor GmbH.

* cited by examiner

*Primary Examiner* — Gary L Laxton
(74) *Attorney, Agent, or Firm* — Saile Ackerman LLC; Stephen B. Ackerman

(57) ABSTRACT

Multi-stage amplifiers, such as linear regulators or linear voltage regulators (e.g. low-dropout regulators) configured to provide a constant output voltage subject to load transients are presented. A multi-stage amplifier, having a differential amplification stage configured to provide a stage output voltage at an output node, based on a first input voltage and a second input voltage is presented. Furthermore, the multi-stage amplifier comprises a second amplification stage comprising an amplifier current source configured to provide an amplifier current; and an amplifier transistor arranged in series with the amplifier current source; wherein a gate of the amplifier transistor is coupled to the output node of the differential amplification stage. In addition, the multi-stage amplifier comprises a detection circuit.

22 Claims, 5 Drawing Sheets

ACTIVE CLAMPS FOR MULTI-STAGE AMPLIFIERS IN OVER/UNDER-VOLTAGE CONDITION

TECHNICAL FIELD

The present document relates to multi-stage amplifiers, such as linear regulators or linear voltage regulators (e.g. low-dropout regulators) configured to provide a constant output voltage subject to load transients.

BACKGROUND

An example of multi-stage amplifiers are low-dropout (LDO) regulators which are linear voltage regulators which can operate with small input-output differential voltages. A typical LDO regulator 100 is illustrated in FIG. 1*a*. The LDO regulator 100 comprises an output amplification stage 103, e.g. a field-effect transistor (FET), at the output and a differential amplification stage or differential amplifier 101 (also referred to as error amplifier) at the input. A first input (fb) 107 of the differential amplifier 101 receives a fraction of the output voltage $V_{out}$ determined by the voltage divider 104 comprising resistors R0 and R1. The second input (ref) to the differential amplifier 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. the power FET, changes by a feedback mechanism called main feedback loop to maintain a constant output voltage $V_{out}$.

The LDO regulator 100 of FIG. 1*a* further comprises an addition intermediate amplification stage 102 configured to amplify the output voltage of the differential amplification stage 101. As such, an intermediate amplification stage 102 may be used to provide an additional gain within the amplification path. Furthermore, the intermediate amplification stage 102 may provide a phase inversion.

In addition, the LDO regulator 100 may comprise an output capacitance $C_{out}$ (also referred to as output capacitor or stabilization capacitor or bypass capacitor) 105 parallel to the load 106. The output capacitor 105 is used to stabilize the output voltage $V_{out}$ subject to a change of the load 106, in particular subject to a change of the load current $I_{load}$. It should be noted that typically the output current $I_{out}$ at the output of the output amplification stage 103 corresponds to the load current $I_{load}$ through the load 106 of the regulator 100 (apart from typically minor currents through the voltage divider 104 and the output capacitance 105). Consequently, the terms output current $I_{out}$ and load current $I_{load}$ are used synonymously, if not specified otherwise.

Typically, it is desirable to provide a stable output voltage $V_{out}$, even subject to transients of the load 106. By way of example, the regulator 100 may be used to provide a stable output voltage $V_{out}$ to the processor of an electronic device (e.g., a smartphone). The load current $I_{load}$ may vary significantly between a sleep state and an active state of the processor, thereby varying the load 106 of the regulator 100. In order to ensure a reliable operation of the processor, the output voltage $V_{out}$ should remain stable, even in response to such load transients.

The regulator 100 shown in FIG. 1*a* is an example of a multi-stage amplifier. The present document is directed at providing multi-stage amplifiers which are configured to maintain a stable output voltage subject to load transients.

SUMMARY

According to an aspect, a multi-stage amplifier, such as a linear regulator, is described. The multi-stage amplifier may comprise a plurality of amplification stages. In particular, the multi-stage amplifier may comprise a differential amplification stage which is configured to provide a stage output voltage at an output node of the differential amplification stage. The stage output voltage may be derived by the differential amplification stage based on a first input voltage and based on a second input voltage. The first input voltage may e.g. correspond to a feedback voltage and the second input voltage may e.g. correspond to a reference voltage. The first input voltage may be provided to the differential amplification stage at a first input node and the second input voltage may be provided at a second input node of the differential amplification stage.

The differential amplification stage may comprise a bias current source configured to provide a bias current. Furthermore, the differential amplification stage may comprise a first input transistor and a second input transistor forming a differential pair, e.g. a P-type (e.g. p-channel) differential pair. The first and second input transistors may comprise or may be P-type (p-channel) metal oxide semiconductor (MOS) field effect transistors (FETs) (also referred to as a MOSFET). Input nodes (e.g. the sources) of the first and second input transistors may be coupled to the bias current source. As such, complementary portions of the bias current may flow through the first and the second input transistors. The output nodes (e.g. the drains) of the first and second input transistors may be coupled with one another via a current mirror.

A gate of the first input transistor may form the first input node for receiving the first input voltage and a gate of the second input transistor may form the second input node for receiving the second input voltage. The output node of the second input transistor may form the output node of the differential amplification stage. In particular, the point between the output node of the second input transistor and an input of the current mirror may form the output node of the differential amplification stage.

The multi-stage amplifier may comprise a second amplification stage. The second amplification stage may comprise an amplifier current source configured to provide an amplifier current. The amplifier current may be a constant current. Furthermore, the second amplification stage may comprise an amplifier transistor arranged in series with the amplifier current source. As such, some or all of the amplifier current may flow through the amplifier transistor. The amplifier transistor may comprise or may be an N-type (e.g. n-channel) MOSFET. A gate of the amplifier transistor may be coupled to the output node of the differential amplification stage. As such, the gate of the amplifier transistor may form an input node of the second amplification stage. A mid-point between the amplifier current source and an input node (e.g. the drain) of the amplifier transistor may form an output node of the second amplification stage. The output node of the second amplification stage may be coupled e.g. to the input of a further amplification stage of the multi-stage amplifier.

In addition, the multi-stage amplifier may comprise a detection circuit. The detection circuit may comprise a detection current source configured to provide a detection current (e.g. a constant detection current). Furthermore, the detection circuit may comprise a detection transistor arranged in series with the detection current source. The detection transistor may comprise or may be an N-type (e.g. n-channel) MOSFET. As such, some or all of the detection current may flow through the detection transistor. A gate of the detection transistor may be coupled to the output node of the differential amplification stage. A mid-point between the detection current source and an input node (e.g. the drain) of the detection transistor may form a sensing point. The detection circuit may be configured to provide an indication of an undervoltage situation or an overvoltage situation at the sensing point.

The second amplification stage and the detection circuit may be arranged in parallel. Furthermore, the detection circuit (in particular, the detection current source and/or the detection transistor) may be configured such that the sensing point changes from a default state to a detection state, subject to the stage output voltage at the output node of the differential amplification stage deviating from a default voltage by at least a pre-determined threshold value. By way of example, in the default state, the sensing point may be at a relatively low voltage level (e.g. at ground voltage level), while in the detection state, the sensing point may be at a relatively high level (e.g. at a level of the supply voltage of the detection circuit). Alternatively, the default state and the detection state may be defined vice versa. The default voltage may correspond to an operating point of the second amplification stage. The pre-determined threshold value may correspond to 10%, 15%, 20%, 25%, 30% or 35% of the default voltage.

The detection circuit may further comprise a clamping transistor arranged in parallel to the first or the second input transistor. In particular, the clamping transistor may be arranged in parallel to the one of the first and second input transistors for which the lower one of the first and second input voltage is expected or is to be detected. A gate of the clamping transistor may be coupled to the sensing point. The detection transistor and/or the detection current source may be configured such that, in the default state, the sensing point is at a voltage level such that the clamping transistor is in off-state (or disabled). Alternatively or in addition, the detection transistor and/or the detection current source may be configured such that, in the detection state, the sensing point is at a voltage level such that the clamping transistor is in on-state (or enabled). Consequently, the clamping transistor may be used to provide a feedback to the differential amplification stage, subject to the sensing point toggling from the default state to the detection state, e.g. subject to the detection of an overvoltage or an undervoltage situation.

The detection circuit may be configured to detect an undervoltage situation for which the first input voltage is lower than the second input voltage by at least a pre-determined input voltage difference. The clamping transistor may be arranged in parallel to the second input transistor. By doing this, the detection circuit may be configured to clamp the stage output node to a fixed voltage level (e.g. to the default voltage minus the pre-determined threshold value), subject to detecting the undervoltage situation.

Alternatively, the detection circuit may be configured to detect an overvoltage situation for which the first input voltage is higher than the second input voltage by at least the pre-determined input voltage difference. The clamping transistor may be arranged in parallel to the first input transistor. By doing this, the detection circuit may be configured to clamp the stage output node to a fixed voltage level (e.g. to the default voltage plus the pre-determined threshold value), subject to detecting the overvoltage situation.

It should be noted that the multi-stage amplifier may further comprise a second detection circuit comprising a second detection current source, a second detection transistor and a second clamping transistor. The second detection circuit may be configured to detect an undervoltage situation (while the (first) detection circuit may be configured to detect an overvoltage situation). The second clamping transistor may be arranged in parallel to the second input transistor. By doing this, the second detection circuit may be configured to clamp the stage output node to a fixed voltage level (e.g. to the default voltage minus the pre-determined threshold value), subject to detecting the undervoltage situation; and the (first) detection circuit may be configured to clamp the stage output node to a fixed voltage level (e.g. to the default voltage plus the pre-determined threshold value), subject to detecting the overvoltage situation.

The clamping transistor(s) may comprise or may be P-type or N-type metal oxide semiconductor field effect transistors (MOSFET). In particular, if the detection circuit is configured to detect an undervoltage situation, an N-type MOSFET may be used as a clamping transistor, and/or if the detection circuit is configured to detect an overvoltage situation, a P-type MOSFET may be used as a clamping transistor.

The detection circuit may comprise a stabilizing capacitor coupled to the sensing point (e.g. coupling the sensing point to ground). The stabilizing capacitor may be used to stabilize the sensing point and the switching state of the clamping transistor.

The multi-stage amplifier may further comprise an output amplification stage configured to provide a load current at an amplifier output voltage to a load (e.g. a processor of an electronic device). An input of the output amplification stage may be (directly or via further intermediate amplification stages) coupled to the output of the second amplification stage. Furthermore, the multi-stage amplifier may comprise voltage sensing means (e.g. a voltage divider) configured to provide an indication of the amplifier output voltage (also referred to as the feedback voltage). The indication of the amplifier output voltage (i.e. the feedback voltage) may be fed back as the first input voltage to the first input node.

According to a further aspect, a system comprising a multi-stage amplifier circuit comprising a differential amplification stage configured to provide a stage output voltage at an output node, based on a first input voltage at a first input node and a second input voltage at a second input node, and a second amplification stage comprising an amplifier current source configured to provide an amplifier current, and an amplifier transistor arranged in series with the amplifier current source; wherein a gate of the amplifier transistor is coupled to the output node of the differential amplification stage, and a detection circuit comprising an undervoltage detection circuit comprising a detection current source configured to provide a detection current; and an overvoltage detection circuit comprising a detection current source configured to provide a detection current, wherein the second amplification stage and the detection circuit are arranged in parallel, wherein the detection circuit are configured such that the sensing point changes from a default state to a detection state, subject to the stage output voltage at the output node deviating from a default voltage by at least a pre-determined threshold value.

According to a further aspect, a method for detecting an undervoltage and/or overvoltage situation of a second amplification stage of a multi-stage amplifier is described. The method comprises providing a stage output voltage at an output node of a differential amplification stage of the multi-stage amplifier. The stage output voltage may be determined based on a first input voltage and based on a second input voltage. Furthermore, the method may comprise providing an amplifier current through an amplifier transistor within the second amplification stage. A gate of the amplifier transistor may be coupled to the output node of the differential amplification stage. In addition, the method may comprise providing a detection current through a detection transistor. A gate of the detection transistor may be coupled to the output node of the differential amplification stage. A mid-point between the detection current source and an input node of the detection transistor may form a sensing point. The detection current and/or the detection transistor may be such that the sensing point changes from a default state to a detection state, subject to the stage output voltage at the output node deviating from a default voltage by at least a pre-determined threshold value.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
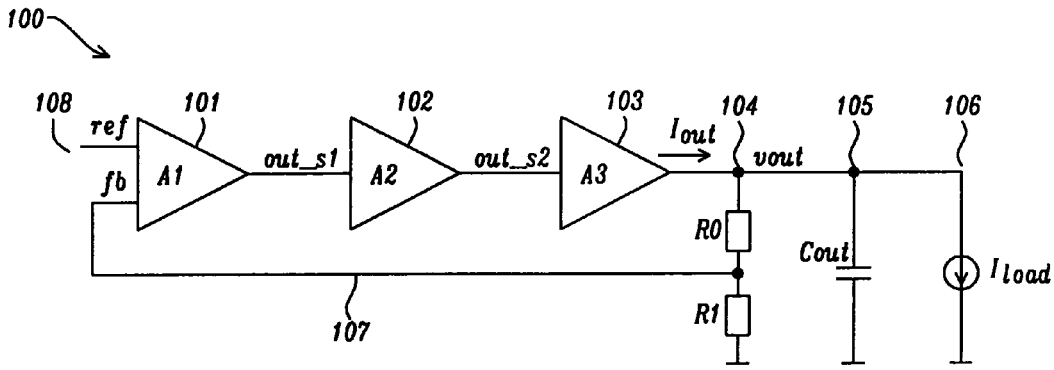
FIG. 1a Prior Art
FIG. 1*a* illustrates an example block diagram of an LDO regulator.
Figure 1B:
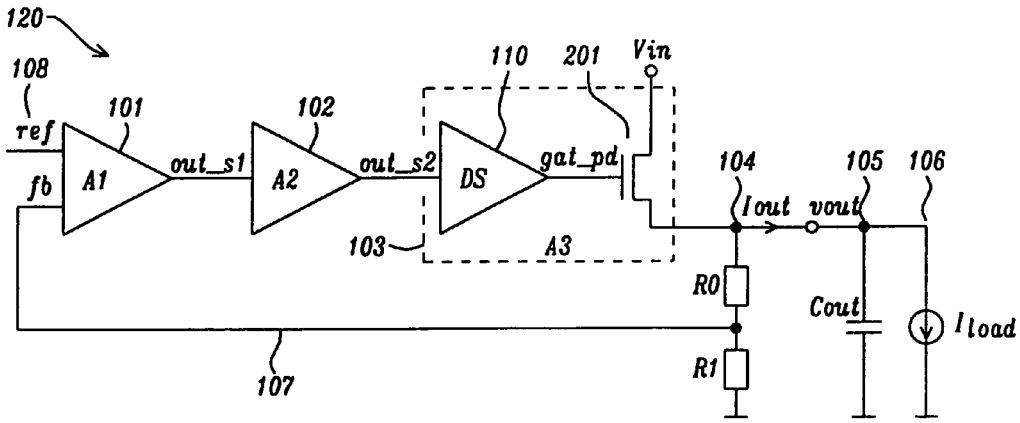
FIG. 1b Prior Art
FIG. 1*b* illustrates the example block diagram of an LDO regulator in more detail.

As already outlined above, FIG. 1*a* shows an example block diagram for an LDO regulator 100 with its three amplification stages A1, A2, A3 (reference numerals 101, 102, 103, respectively). FIG. 1*b* illustrates the block diagram of a LDO regulator 120, wherein the output amplification stage A3 (reference numeral 103) is depicted in more detail. In particular, the pass transistor 201 and the driver stage 110 of the output amplification stage 103 are shown. Typical parameters of an LDO regulator are a supply voltage of 3V, an output voltage of 2V, and an output current or load current ranging from 1 mA to 100 or 200 mA. Other configurations are possible. The present invention is described in the context of a linear regulator. It should be noted, however, that the present invention is applicable to multi-state amplifiers in general.

It is desirable to provide a multi-stage amplifier such as the regulator 100, 120, which is configured to generate a stable output voltage $V_{out}$ subject to load transients. The output capacitor 105 may be used to stabilize the output voltage $V_{out}$, because in case of a load transient, an additional load current $I_{load}$ may be provided by the output capacitor 105. Furthermore, schemes such as Miller compensation and/or load current dependent compensation may be used to stabilize the output voltage $V_{out}$.

Figure 2:
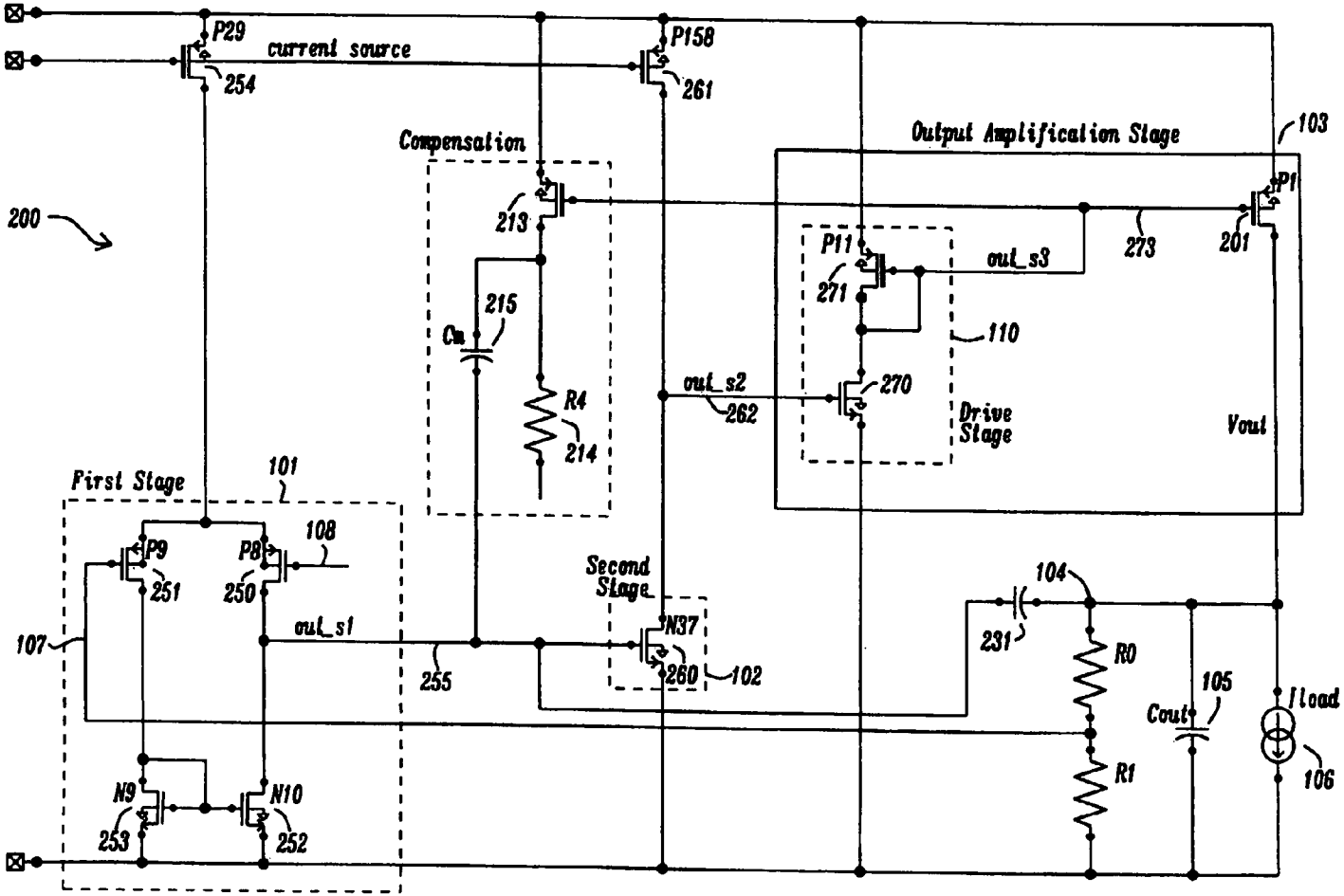
FIG. 2 Prior Art
FIG. 2 shows an example circuit arrangement of an LDO regulator.

FIG. 2 illustrates an example circuit arrangement of an LDO regulator 200 comprising a Miller compensation using a capacitance $C_V$ 231 (also referred to as the Miller Feedback Capacitor) and a load current dependent compensation comprising a current mirror with transistors 201 (corresponding to the pass transistor 201) and 213, a compensation resistor 214 and a compensation capacitance $C_m$ 215. Furthermore, the LDO regulator 200 may comprise a capacitor in parallel to the upper resistor R0 of the feedback voltage divider (not shown in FIG. 2).

The circuit implementation of FIG. 2 can be mapped to the block diagrams in FIGS. 1*a* and 1*b*, as similar components have received the same reference numerals. In the circuit arrangement 200, the differential amplification stage 101, the intermediate amplification stage 102 and the output amplification stage 103 are implemented using field effect transistors (FET), e.g. metal oxide semiconductor FETs (MOSFETs).

The differential amplification stage 101 comprises the differential input pair of transistors P9 251 and P8 250, and the current mirror N9 253 and N10 252. The input of the differential pair is e.g. a 1.2V reference voltage 108 at P8 and the feedback 107 at P9 which is derived from the resistive divider 104 (with e.g. R0=0.8MΩ and R1=1.2MΩ).

The intermediate amplification stage 102 comprises a transistor N37 260, wherein the gate of transistor N37 260 is coupled to the output node 255 of the differential stage 101. The transistor P158 261 acts as a current source for the intermediate amplification stage 102, similar to transistor P29 254 which acts as a current source for the differential amplification stage 101.

The output amplification stage 103 is coupled to the output node 262 of the intermediate amplification stage 102 and comprises a pass device or pass transistor 201 and a gate driver stage 110 for the pass device 201, wherein the gate driver stage comprises a transistor 270 and a transistor P11 271 connected as a diode. This gate driver stage has essentially no gain since it is low-ohmic through the transistor diode P11 271 which yields a resistance of $1/g_m$ (output resistance of the driver stage 110 of the output amplification stage 103) to signal ground. The gate of the pass transistor 201 is identified in FIG. 2 with reference numeral 273.

In the present document, means for stabilizing the output voltage of a multi-stage amplifier such as the regulator 200 are described. These means may be used in conjunction with other stabilizing means, such as an output capacitor 105, Miller compensation 231 and/or load current dependent compensation 213, 214, 215. The described stabilizing means allow for a rapid recovery of the multi-stage amplifier subject to load transients.

In normal operation the operating points of the different amplifier stages 101, 102, 103 of a multi-stage amplifier 100, 120, 200 are defined by feedback mechanisms (such as the voltage divider 104 feeding back the feedback voltage 107) which are set by internal or external currents or voltages. However there are conditions such as over- and undervoltage in which the one or more intermediate amplification stages 102 are driven out of their operating points, because of the difference of the input voltages 107, 108 to the differential amplification stage 101 being too large. Such a situation may occur in response to a load transient at the output of the multi-stage amplifier 100, 200, which may cause the feedback voltage 107 to drop or to increase, thereby yielding an absolute difference with respect to the reference voltage 108 which exceeds a pre-determined difference threshold. Alternatively or in addition, such a situation may occur in response to a modification of the reference voltage 108.

Because of the high gain of the one or more intermediate amplification stages 102 already a relatively small voltage difference at the input of the differential amplification stage 101 may lead to a situation where the one or more intermediate amplification stages 102 are driven out of their respective operating points.

A dedicated overvoltage comparator may be used to detect such an overvoltage situation and to discharge the output capacitor 105, in response to detecting an overvoltage situation (e.g. when the feedback voltage 107 exceeds the reference voltage 108 by at least the difference threshold). When using an overvoltage comparator, a mismatch needs to be evaluated in order to minimize a gap between a detected overvoltage mode (where the output capacitor 105 is discharged) and the normal mode and in order to avoid an overlap to these modes.

Once the one or more intermediate amplification stages 102 have left their respective operating points, the one or more intermediate amplifiers 102 become delay lines rather than linear amplifiers, because of the saturated states of the internal gain stages. This could cause relatively large current spikes or oscillating limit cycles when the multi-stage amplifier 100, 200 is trying to recover the steady state. Furthermore, the recovery is typically strongly dependent on the nonlinear properties (e.g. the threshold voltage VTH of the transistors and/or the gate drive voltage of the transistor, indicative of the transistor dimension and the current through the transistors) of the transistors used within the multi-stage amplifier 100, 200.

In the present document, a detection circuit is described which is configured to sense the operating state of amplification stages within a multi-stage amplifier. The detection circuit may comprise matched devices (e.g. matched transistors) and/or matched current sources. Furthermore, the detection circuit may comprise a clamping device which forms a feedback loop to the matched devices.

Figure 3A:
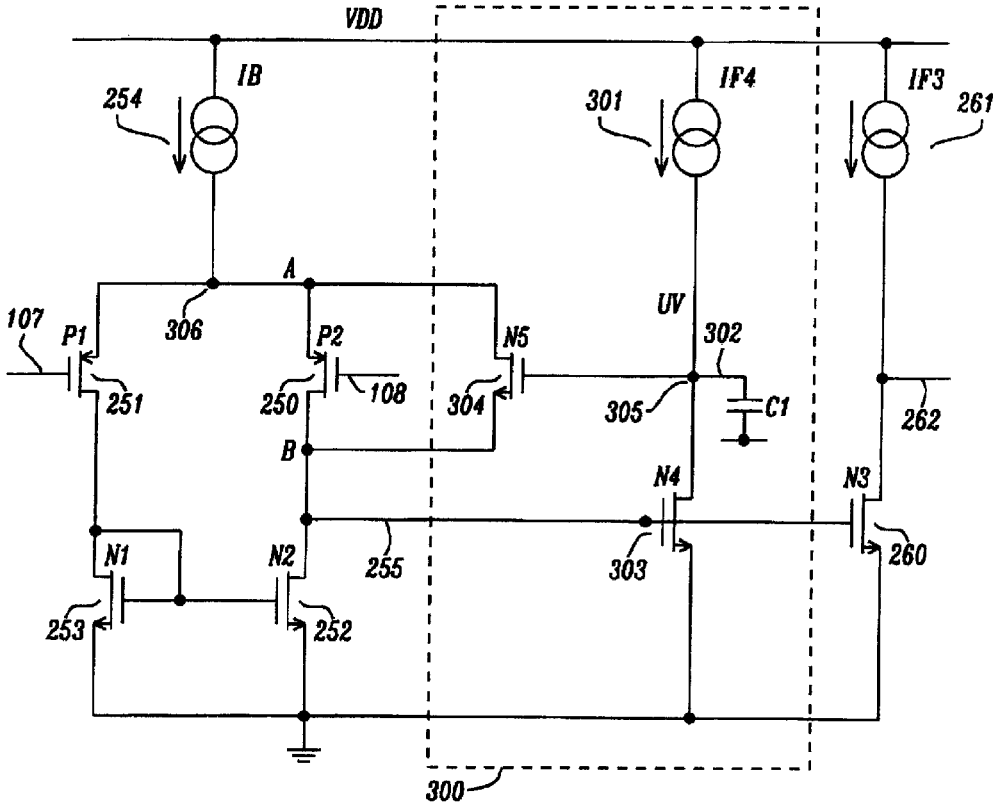
FIG. 3*a* shows an example circuit arrangement comprising a differential amplification stage, an intermediate amplification stage and a detector circuit for undervoltage detection.

FIG. 3*a* shows a circuit diagram of an example detection circuit 300 which is configured to detect an undervoltage situation. The detection circuit 300 may be arranged in parallel to the intermediate amplification stage 102 at the output 255 of the differential amplification stage 101. The detection circuit 300 may be configured to provide information on whether the intermediate amplification stage 102 is in undervoltage condition. The operating condition of the intermediate amplification stage 102 (also referred to as the second amplification stage 102) may be sensed based on the voltage at the output node 255 of the differential amplification stage 101 (also referred to as the first amplification stage 101).

The intermediate amplification stage 102 may work on a fixed current using the current source 261. A matched transistor N4 303 may be added, the matched transistor 303 being supplied with another fixed current IF4 using current source 301. The ratio of the currents and transistors of the detection circuit 300 and of the intermediate amplification stage 102 may be set in such a way that in normal operating mode the undervoltage sensing node 305 is pulled low. For this purpose, the detection transistor 303 may be designed such that if the voltage at the output 255 of the differential amplification stage 101 is within the normal operating range, the detection transistor 303 is in on-state (i.e. closed), such that the undervoltage sensor node 305 is coupled to ground. The detection circuit 300 may comprise a stability capacitor 302 which may be added to the undervoltage sensing node 305 to provide stability.

The detection circuit 300 may comprise an active clamp N5 304 (comprising e.g. an NMOS transistor), which is arranged in parallel (with respect to Source and Drain) to the transistor P2 250 of the differential pair of the differential amplification stage 101. In particular, the clamp transistor 304 may be coupled to the node A 306 at the output of the current source 254 and to the output node B 255 of the differential amplification stage 101. The gate of the clamp transistor 304 may be coupled to the undervoltage sensing node 305.

In case of an undervoltage situation the output node 255 of the differential amplification stage 101 is pulled low, therefore reducing the current through the matched sense device 303 (also referred to as the detection transistor). As soon as a defined minimum current through the detection transistor 303 is reached, the sensing node 305 is pulled high and eventually enables the clamp device N5 304 and thereby closes the feedback loop.

The undervoltage situation (e.g. when the feedback voltage $V_{fb}$, at the input node 107 is significantly lower than the reference voltage $V_{ref}$ at the input node 108, the voltages being referenced to ground) may lead to a situation, where the fraction of the current $I_B$ provided by the current source 254, which traverses the transistor P2 250, is lower than the fraction of the current $I_B$, which traverses the transistor P1 251. As a consequence, the voltage at the output node 255 is reduced, thereby triggering the clamp device 304 to be enabled (i.e. to be closed).

As a result of the enabling of the clamp transistor 304, the current branches (through the transistor P1 251 and the transistor P2 250, respectively) of the differential amplification stage 101 that carried different currents because of the undervoltage situation, become equalized and the output 255 of differential amplification stage 101 gets clamped and defined by the operating point of the undervoltage detection circuit 300. In other words, the undervoltage detection circuit 300 is configured to clamp or to fix the second amplification stage 102 to the operating point of the undervoltage detection circuit 300. In particular, the voltage at the output node 255 may be clamped or fixed to as particular value, which is fixed by the undervoltage detection circuit 300 (notably by the detection transistor 303 and by the current source 301). The particular voltage value may be 10%, 15% or 20% below the voltage level of the operation point of the second (e.g. the intermediate) amplification stage 102.

The intermediate amplification stage 102 comprising the transistor N3 260 is typically trying to recover from the undervoltage condition by increasing the output current at the output node 262 of the intermediate amplification stage 102. As soon as the output 255 of the differential amplification stage 101 is being raised, the clamping caused by the clamp transistor 304 is turned off and only a small fraction (or a small delta) from the gate voltage in clamped mode to the gate voltage in normal mode needs to be overcome to get back to normal operation. Due to the limited voltage range at the sensing node, recovery from an overvoltage or undervoltage situation is sped up and stabilized. In other words, due to the fact, that the undervoltage situation of the second amplification stage 102 is clamped or fixed to a pre-determined level, the recovery time for the second amplification stage 102 to return to its operating point may be reduced compared to the recovery time needed without the detection circuit 300 (and in particular without the clamping of the output node 255).

As such, the undervoltage detection circuit 300 may be configured to detect a situation where the output voltage at the output node 255 of the first (e.g. the differential) amplification stage 101 is at or falls below a pre-determined low voltage threshold. The pre-determined low voltage threshold may be at least 10%, 15% or 20% below the voltage level of the operation point of the second (e.g. the intermediate) amplification stage 102. The pre-determined low voltage threshold may be set by an appropriate design of the detection transistor 303 and the detection current source 301 of the undervoltage detection circuit 300.

The undervoltage detection circuit 300 may be configured to clamp the first amplification stage 101, such that the output voltage at the output node 255 does not continue to fall. By way of example, the undervoltage detection circuit 300 may be configured to clamp the output voltage at the output node 255 to the low voltage threshold. This may be achieved by using the clamp transistor 304 which is arranged in parallel to the input transistor 250 of the first amplification stage 101 which is coupled to the reference voltage 108. That is, the clamp transistor 304 may be arranged in parallel to the input transistor 250 of the differential amplification stage 101, which comprises the input node receiving the lower one of the reference voltage 108 and the feedback voltage 107.

Figure 3B:
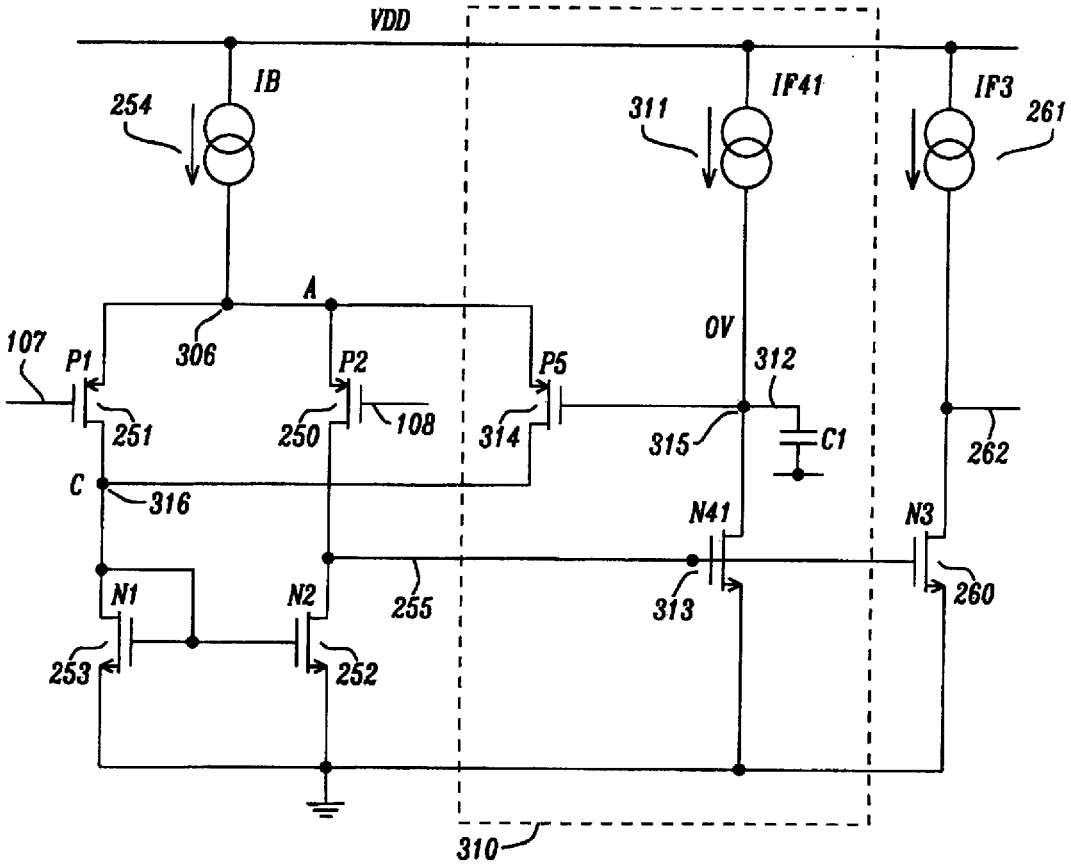
FIG. 3*b* shows an example circuit arrangement comprising a differential amplification stage, an intermediate amplification stage and a detector circuit for overvoltage detection.

FIG. 3*b* shows the circuit diagram of an example overvoltage detection circuit 310 which is configured to detect an overvoltage situation and which is configured to clamp the first amplification stage 101 to a pre-determined clamped operating mode. The overvoltage detection circuit 310 may be designed in an analogous manner to the undervoltage detection circuit 300. The detection circuit 310 comprises a detection transistor 313 and a current source 311, which are arranged in parallel to the second amplification stage 102 at the output 255 of the first amplification stage 101. The current through the detection transistor 313 (which typically depends on the voltage at the node 255) provides an indication on whether the first and/or second amplification stage 101, 102 is in overvoltage condition.

The second amplification stage 102 is typically working on a fixed current provided by the current source 261. The detection circuit 310 comprises a matched transistor 313 which is supplied by another fixed current (using the current source 311) of the same type as the current provided in the second amplification stage 102. The ratio of currents and transistors may be set in such a way that in normal operating mode the overvoltage sensor node 315 is pulled high. As such, the detection transistor 313 and/or the current source 311 may be designed such that if the output voltage at the output node 255 of the first amplification stage 101 is at the operating point of the second amplification stage 102, the overvoltage sensing node 315 is pulled high.

An active clamp P5 314 (e.g. a PMOS transistor) may be provided in parallel (S/D) to the transistor P1 251 of the differential pair of the first amplification stage 101. In particular, the clamp transistor 314 may be coupled to the node A 306 and to the node C 316 of the first amplification stage 101. The gate of the clamp transistor 314 may be connected to that sensing node 315. In a similar manner as in the undervoltage detection circuit 300, a stability capacitor C2 312 may be added to the sensing node 315 to increase stability.

In case of an overvoltage situation, the output 255 of first amplification stage 101 is pulled high, therefore increasing the current of the matched sense device N41 313. As soon as a pre-defined current threshold is reached, the sensor node 315 is pulled low and eventually enables the clamp device P5 314 and closes the feedback loop.

The current branches of the first amplification stage 101 that were different because of the overvoltage situation, will typically become equalized by the feedback and the output 255 of the first amplification stage 101 will typically get clamped and defined by the operating point of the overvoltage detection circuit 310 (notably by the operating point defined by the detection transistor 313 and the detection current source 311).

The transistor N3 260 of the second amplification stage 102 typically tries to recover from the overvoltage condition by decreasing the output current at the output node 262. However, the extent of decreasing the output current is limited due to the clamping of the first amplification stage 101. As soon as the output 255 is being lowered the clamping is turned off and only a small fraction (or delta) from the gate voltage in clamped mode to the gate voltage in normal mode needs to be overcome to get back to normal operation.

In other words, the overvoltage detection circuit 310 may be configured to detect a situation where the output voltage at the output node 255 of the first (e.g. the differential) amplification stage 101 is at or rises above a pre-determined high voltage threshold. The high voltage threshold may be at least 10%, 15% or 20% above the voltage level of the operation point of the second (e.g. the intermediate) amplification stage 102. The pre-determined high voltage threshold may be set by an appropriate design of the detection transistor 313 and the detection current source 311 of the overvoltage detection circuit 300.

The overvoltage detection circuit 310 may be configured to clamp the first amplification stage 101, such that the output voltage at the output node 255 does not continue to rise. By way of example, the overvoltage detection circuit 310 may be configured to clamp the output voltage at the output node 255 to the high voltage threshold. This may be achieved by using the clamp transistor 314 which is arranged in parallel to the input transistor 251 of the first amplification stage 101 which is coupled to the feedback voltage 107.

It should be noted that the overvoltage detection circuit 310 and the undervoltage detection circuit 300 may be used concurrently, thereby enabling the detection and the limitation of an overvoltage situation and an undervoltage situation.

Furthermore, it should be noted that the undervoltage sensing node 305 and/or the overvoltage sensing node 315 may be used to control alternative or additional stabilizing schemes. By way of example, appropriate inverter stages could be added to the nodes 305, 315 to form digital signals that could be used to trigger signals and functions such as dischargers etc. (e.g. for the discharging of the output capacitor 105).

Figure 4:
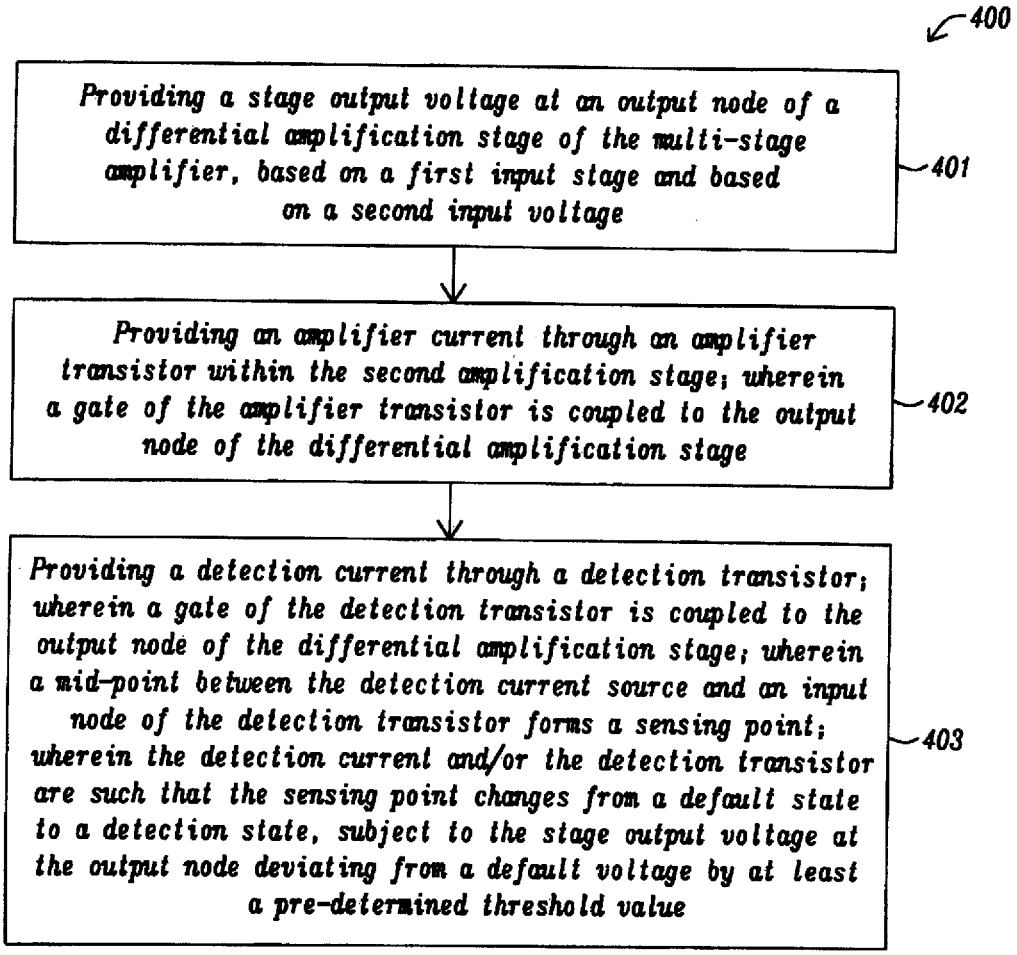
FIG. 4 shows a flow chart of an example method for detecting under-/overvoltage situations of a differential amplification stage.

FIG. 4 shows a flow chart of an example method 400 for detecting an undervoltage and/or overvoltage situation of a second amplification stage 102 of a multi-stage amplifier 100, 200. The method 400 comprises providing 401 a stage output voltage at an output node 255 of a differential amplification stage 101 of the multi-stage amplifier 100, 200, based on a first input voltage 107 (e.g. based on the feedback voltage) and based on a second input voltage 108 (e.g. based on the reference voltage). Furthermore, the method 400 comprises providing 402 an amplifier current through an amplifier transistor 260 within the second amplification stage 102. A gate of the amplifier transistor 260 may be (directly) coupled to the output node 255 of the differential amplification stage 101. In addition, the method 400 comprises providing 403 a detection current through a detection transistor 303, 313. A gate of the detection transistor 303, 313 may be (directly) coupled to the output node 255 of the differential amplification stage 101. A mid-point between the detection current source 301, 311 and an input node of the detection transistor 303, 313 may form a sensing point 305, 315. The detection current and/or the detection transistor 303, 313 may be such that the sensing point 305, 315 changes from a default state to a detection state, subject to the stage output voltage at the output node 255 deviating from a default voltage by at least a pre-determined threshold value.

In the present document, an overvoltage detection circuit and an undervoltage detection circuit have been described. The circuits allow for a fast and reliable recovery from over- and/or undervolt conditions. Furthermore, the circuits enable the detection of over/under voltage conditions without the use of additional differential pairs (comparators). This leads to an improved mismatch control in order to avoid overlapping operating modes. The described circuits provide a robust matched clamping function which is realized using a feedback. As a result of the feedback, the first amplification stage is forced into a state, where the bias current $I_B$ is split equally in both current branches of the first amplification stage despite of external voltage conditions.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A multi-stage amplifier comprising a differential amplification stage configured to provide a stage output voltage at an output node, based on a first input voltage at a first input node and a second input voltage at a second input node; wherein the differential amplification stage comprises a first input transistor and a second input transistor forming a differential pair, wherein a gate of the first input transistor forms the first input node for receiving the first input voltage; wherein a gate of the second input transistor forms the second input node for receiving the second input voltage; and wherein an output node of the second input transistor forms the output node of the differential amplification stage;

a second amplification stage comprising an amplifier current source configured to provide an amplifier current; and an amplifier transistor arranged in series with the amplifier current source; wherein a gate of the amplifier transistor is coupled to the output node of the differential amplification stage; and a detection circuit comprising a detection current source configured to provide a detection current;

a detection transistor arranged in series with the detection current source; wherein a gate of the detection transistor is coupled to the output node of the differential amplification stage; wherein a mid-point between the detection current source and an input node of the detection transistor forms a sensing point; and a clamping transistor arranged in parallel to the first or the second input transistor; wherein a gate of the clamping transistor is coupled to the sensing point;

wherein the detection circuit is configured such that the sensing point changes from a default state to a detection state, subject to the stage output voltage at the output node deviating from a default voltage by at least a pre-determined threshold value.

2. The multi-stage amplifier of claim 1, wherein in the default state, the sensing point is substantially at ground voltage level; and wherein in the detection state, the sensing point is substantially at a level of a supply voltage of the detection circuit; or vice versa.

3. The multi-stage amplifier of claim 1, wherein the default voltage corresponds to an operating point of the second amplification stage; and/or the pre-determined threshold value corresponds to 10%, 15%, 20%, 25%, 30% or 35% of the default voltage.

4. The multi-stage amplifier of claim 1, wherein the differential amplification stage comprises a bias current source configured to provide a bias current;

input nodes of the first and second input transistors are coupled to the bias current source.

5. The multi-stage amplifier of claim 1, wherein the clamping transistor is arranged in parallel to one of the first and second input transistors receiving a lower one of the first and second input voltage.

6. The multi-stage amplifier of claim 1, wherein the detection transistor and/or the detection current source are configured such that, in the default state, the sensing point is such that the clamping transistor is in off-state; and the detection transistor and/or the detection current source are configured such that, in the detection state, the sensing point is such that the clamping transistor is in on-state.

7. The multi-stage amplifier of claim 1, wherein the detection circuit is configured to detect an undervoltage situation for which the first input voltage is lower than the second input voltage by at least a pre-determined input voltage difference; and the clamping transistor is arranged in parallel to the second input transistor.

8. The multi-stage amplifier of claim 1, wherein the detection circuit is configured to detect an overvoltage situation for which the first input voltage is higher than the second input voltage by at least a pre-determined input voltage difference; and the clamping transistor is arranged in parallel to the first input transistor.

9. The multi-stage amplifier of claim 8, wherein the multi-stage amplifier further comprises a second detection circuit comprising a second detection current source, a second detection transistor and a second clamping transistor;

the second detection circuit is configured to detect an undervoltage situation; and the second clamping transistor is arranged in parallel to the second input transistor.

10. The multi-stage amplifier of claim 1, wherein the clamping transistor comprises a P-type or an N-type metal oxide semiconductor field effect transistor.

11. The multi-stage amplifier of claim 1, wherein the amplifier transistor and the detection transistor are N-type metal oxide semiconductor field effect transistors; and/or the amplifier current and the detection current are constant; and/or a mid-point between the amplifier current source and an input node of the amplifier transistor forms an output node of the second amplification stage; and/or the gate of the amplifier transistor forms an input node of the second amplification stage.

12. The multi-stage amplifier of claim 1, wherein the detection circuit comprises a stabilizing capacitor coupled to the sensing point.

13. The multi-stage amplifier of claim 1, further comprising an output amplification stage configured to provide a load current at an amplifier output voltage to a load; wherein an input of the output amplification stage is coupled to an output of the second amplification stage; and voltage sensing means configured to provide an indication of the amplifier output voltage; wherein the indication of the amplifier output voltage is fed back as the first input voltage to the first input node.

14. A system comprising a multi-stage amplifier circuit comprising a differential amplification stage configured to provide a stage output voltage at an output node, based on a first input voltage at a first input node and a second input voltage at a second input node of the differential amplification stage, wherein said multi-stage amplifier differential amplification stage comprises a bias current source configured to provide a bias current; and a first input transistor and a second input transistor forming a differential pair; wherein an input node of the first input transistor and an input node of the second input transistor are coupled to the bias current source; wherein a gate of the first input transistor forms the first input node for receiving the first input voltage; wherein a gate of the second input transistor forms the second input node for receiving the second input voltage; and wherein an output node of the second input transistor forms the output node of the differential amplification stage; and wherein the multi-stage amplifier circuit further comprises a second amplification stage comprising an amplifier current source configured to provide an amplifier current; and an amplifier transistor arranged in series with the amplifier current source; wherein a gate of the amplifier transistor is coupled to the output node of the differential amplification stage; and a detection circuit comprising an undervoltage detection circuit comprising a detection current source configured to provide a detection current; and an overvoltage detection circuit comprising a detection current source configured to provide a detection current;

wherein the second amplification stage and the detection circuit are arranged in parallel; wherein the detection circuit is configured such that the sensing point changes from a default state to a detection state, subject to the stage output voltage at the output node deviating from a default voltage by at least a pre-determined threshold value.

15. The system of claim 14 wherein said detection circuit comprises a detection transistor arranged in series with the detection current source; wherein a gate of the detection transistor is coupled to the output node of the differential amplification stage; wherein a mid-point between the detection current source and an input node of the detection transistor forms a sensing point.

16. The system of claim 14 wherein said multi-stage amplifier wherein the default voltage corresponds to an operating point of the second amplification stage; and/or the pre-determined threshold value corresponds to 10%, 15%, 20%, 25%, 30% or 35% of the default voltage.

17. The system of claim 14 wherein the detection circuit further comprises a clamping transistor arranged in parallel to the first or the second input transistor and a gate of the clamping transistor is coupled to the sensing point.

18. A method for detecting an undervoltage and/or overvoltage situation of a second amplification stage of a multi-stage amplifier, the method comprising providing a stage output voltage at an output node of a differential amplification stage of the multi-stage amplifier, based on a first input voltage and based on a second input voltage; wherein the differential amplification stage comprises a first input transistor and a second input transistor forming a differential pair; wherein a gate of the first input transistor forms a first input node for receiving the first input voltage; wherein a gate of the second input transistor forms a second input node for receiving the second input voltage; and wherein an output node of the second input transistor forms the output node of the differential amplification stage;

providing an amplifier current through an amplifier transistor within the second amplification stage; wherein a gate of the amplifier transistor is coupled to the output node of the differential amplification stage;

providing a detection current through a detection transistor; wherein a gate of the detection transistor is coupled to the output node of the differential amplification stage; wherein a mid-point between the detection current source and an input node of the detection transistor forms a sensing point; and providing a clamping transistor arranged in parallel to the first or the second input transistor; wherein a gate of the clamping transistor is coupled to the sensing point;

wherein the detection current and/or the detection transistor are such that the sensing point changes from a default state to a detection state, subject to the stage output voltage at the output node deviating from a default voltage by at least a pre-determined threshold value.

19. The method of claim 18, wherein said detection circuit comprises an undervoltage detection circuit and overvoltage detection circuit.

20. The method of claim 19, wherein said undervoltage detection circuit responds to an undervoltage condition.

21. The method of claim 19, wherein said overvoltage detection circuit detection responds to an overvoltage condition.

22. The method of claim 18 wherein said undervoltage/overvoltage condition is a load transient.

* * * * *